United States Patent [19]

Preller

[11] 4,433,565

[45] Feb. 28, 1984

[54] METHOD OF AND APPARATUS FOR THE MANUFACTURING OF METAL PROFILE MEMBERS, ESPECIALLY STEEL PROFILE MEMBERS

[75] Inventor: Hans Preller, Cologne, Fed. Rep. of Germany

[73] Assignee: Theodor Wuppermann GmbH., Leverkusen, Fed. Rep. of Germany

[21] Appl. No.: 262,660

[22] Filed: May 11, 1981

Related U.S. Application Data

[63] Continuation of Ser. No. 24,834, Mar. 28, 1979, abandoned.

[30] Foreign Application Priority Data

Mar. 30, 1978 [DE] Fed. Rep. of Germany ..... 2813636

[51] Int. Cl.[3] ..... B21D 47/01; B21D 37/16

[52] U.S. Cl. ..... 72/177; 72/202; 72/342; 72/366

[58] Field of Search ..... 72/201, 202, 200, 128, 72/178, 181, 234, 377, 342, 177

[56] References Cited

U.S. PATENT DOCUMENTS

| | | | |
|---|---|---|---|
| 1,343,753 | 6/1920 | Sloper | 72/181 |
| 1,584,378 | 5/1926 | Jones | 72/181 |
| 1,819,763 | 8/1931 | Blecker | 72/200 |
| 2,184,150 | 12/1939 | Parker et al. | 72/202 |
| 2,193,737 | 3/1940 | Penkala | 72/342 |
| 2,246,578 | 6/1941 | De Salardi | 72/200 |
| 2,708,958 | 5/1955 | Crafton | 72/181 |
| 2,897,698 | 8/1959 | Van Ormer | 72/202 |
| 3,151,197 | 9/1964 | Schultz | 72/201 |
| 3,208,253 | 9/1965 | Roberts | 72/201 |
| 3,251,215 | 5/1966 | Graef | 72/200 |
| 3,323,342 | 6/1967 | Baker | 72/342 |
| 3,469,430 | 9/1969 | Bray et al. | 72/200 |
| 3,545,244 | 12/1970 | Kabelka | 72/200 |
| 3,664,166 | 5/1972 | Gay | 72/234 |
| 3,988,914 | 11/1976 | Metcalfe et al. | 72/342 |

FOREIGN PATENT DOCUMENTS

| | | | |
|---|---|---|---|
| 1950708 | 4/1971 | Fed. Rep. of Germany | 72/342 |

*Primary Examiner*—Daniel C. Crane
*Attorney, Agent, or Firm*—John C. Smith, Jr.

[57] ABSTRACT

A method and apparatus for manufacturing metal profile members of open or closed construction, especially steel profile members, wherein a continuous band-like metal material of uniform wall thickness as viewed in cross-section is continuously fed along a path where it is continuously deformed by cold- and hot-shaping procedures to produce the profile member. The profile member produced in accordance with this process has one or more differences in wall thickness at one or more predetermined points in its cross-sectional width. During the hot-shaping procedure, at least one predetermined portion of the cross-sectional width of the band-like material is heated to soften that portion after which the band-like material is passed between pairs of discs disposed on opposite sides of the heat-softened portion, the angle of the discs relative to the band-like material being adjustable to cause the heat-softened area to be stretched or compacted.

24 Claims, 26 Drawing Figures

FIG. 1
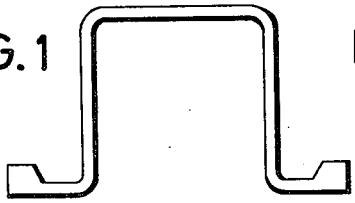
FIG. 2
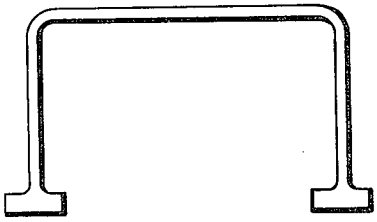
FIG. 3
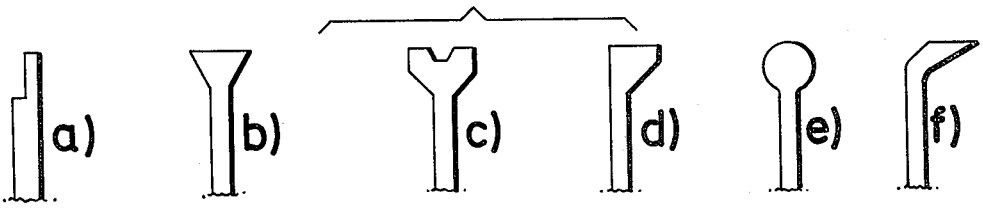
FIG. 4
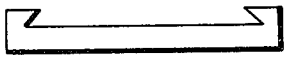
FIG. 5
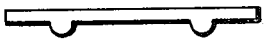
FIG. 6
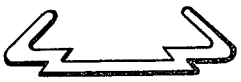
FIG. 7
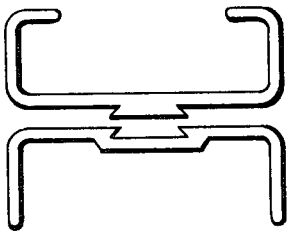
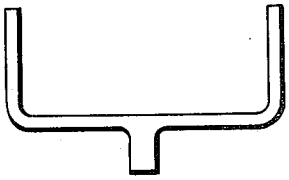
FIG. 8
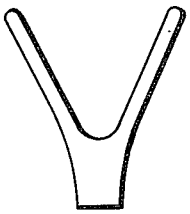
FIG. 9
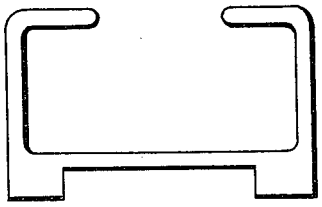
FIG. 10
FIG. 11
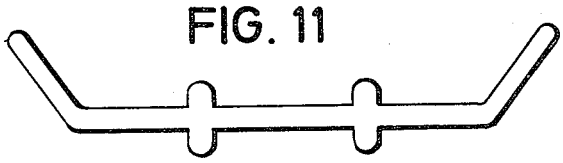

FIG. 24
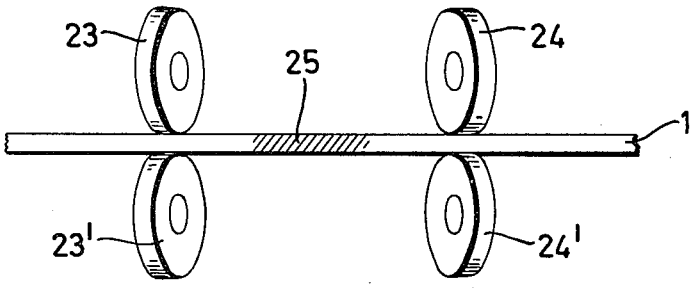
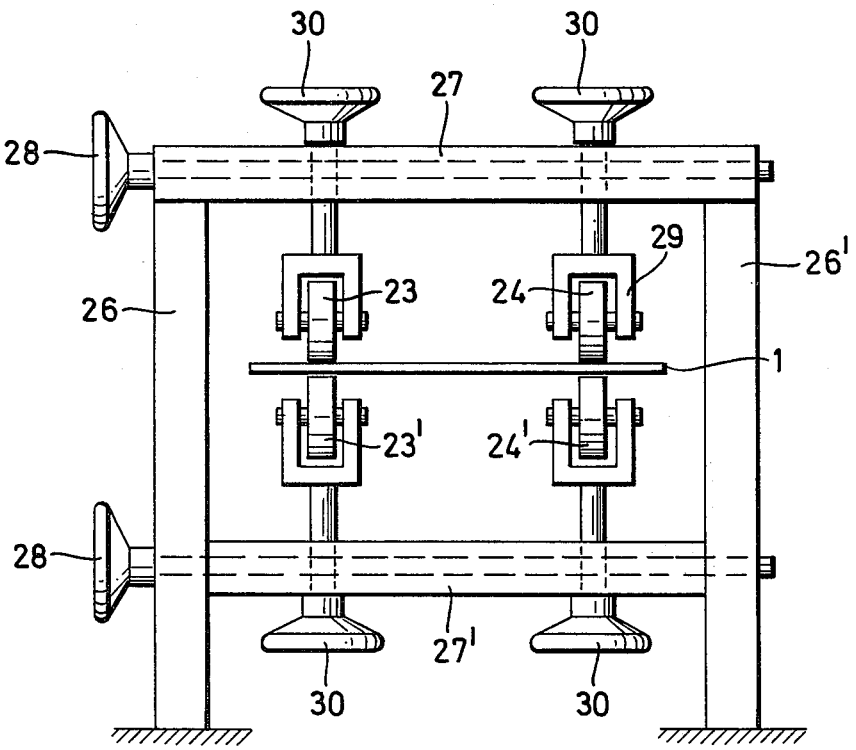
FIG. 25

METHOD OF AND APPARATUS FOR THE MANUFACTURING OF METAL PROFILE MEMBERS, ESPECIALLY STEEL PROFILE MEMBERS

This is a continuation of application Ser. No. 024,834 filed Mar. 28, 1979, now abandoned.

CROSS-REFERENCE TO RELATED APPLICATION

My application entitled "METHOD OF AND APPARATUS FOR THE PRODUCTION OF PROFILE MEMBERS AND HOLLOW BODIES FROM A PLURALITY OF METAL STRIPS OF CONSTANT THICKNESS" and executed on even date herewith is incorporated by reference in its entirety.

BACKGROUND OF THE INVENTION

This invention relates to a method of and apparatus for the continuous manufacture of metal profile members of open or closed construction, especially steel profile members, from a continuous band or strip of metal.

Metal profile members of closed or open construction having a wide variety of different cross-sectional configurations are commonly produced in a continuous manufacturing process involving hot- or cold-rolling.

Hot rolling is used for the manufacture in large batches of open profile members having simple cross-sectional configurations. However, hot-rolling is not suitable for the production of profile members having complex cross-sectional configurations or in certain instances where there is an extreme relation between the dimension and thickness of a profile member. Extrusion processes permit the production of complex open and closed metal profile members within certain narrow limitations. However, such extrusion processes are generally very costly.

In addition to the above-mentioned hot deformation processes which require the initial materials, e.g., ingots, billots, stampings, etc., to be uniformly heated to a high temperature to permit deformation, a substantial amount of rod-shaped profile members are produced by cold deformation at room temperature from sheet and strip metal by means of profile rolling, camphoring and drawing. Profile members obtained by cold deformation generally are limited to those having cross-sections of substantially uniform wall thickness except in those areas where bending occurs during the cold deformation operation. Furthermore, cold-shaping requires for leverage purposes a minimum width of the material depending upon the thickness and the quality of the material and upon the bending radii of the material.

A wide variety of hot- and cold-shaping methods are used for the production of tube sections. A common factor in all of these processes, however, is that as a general rule the wall thickness must be constant over the entire cross-section. Only in special instances is it possible by utilizing more expensive extrusion processes to produce members having tubular cross-sections with differences of wall thickness, and in these instances this is possible only within certain limits.

There has long been an extensive need for rod-like profile members, especially steel profile members having open or closed cross-sectional configurations, which cannot be produced, for either technical or economic reasons, by any of the above-mentioned known methods. The profile members which are produced are relatively thin walled, and the main part of the cross-section of such profile members is of uniform thickness. Only in certain parts of the cross-section is it possible to reduce or increase the thickness by shifting the material of the profile member laterally as it is being produced to provide local reductions or accumulations of material. With respect to the formation of local accumulations of material within the cross-section, attempts have been directed to develop mainly cold processes for producing profile members having acute angled outer radii. Such processes require the use of hot-rolled bands of metal material having one or more beads therein which are shaped by cold processes (see *Journal of the German Research Body for Sheet Metal Working and Surface Treatment* (Regd. Assocn.) and Mitteilungen Der Deutschen Forschungsgesellschaft für Boechberarbeitung und Oberflächenbehandlung e. V., Vol. 19, 1968, No. 13, pp. 209–221). This technology has, however, been superseded by modern hot-rolling processes since it is not feasible to provide a substantial number of different types of bead-containing metal band material, particularly when only small batches of metal profile members are being produced.

Attempts have also been made to partially heat cold-formed products in order to alter certain parts of the material, especially the bent edges, the thickness of the material remaining unaltered.

Also, it is known to improve cold-shaping by elevating the process temperature. Various heat sources have been used which heat not only the band material but also the shaping tools. However, hot-shaping temperatures in excess of 800° C. have not been attempted, the object having been merely to facilitate the shaping of materials which are either difficult or impossible to deform at room temperature. These methods are not significant industrially (Bänder-Bleche-Rohre, August 1967, No. 7, pp. 458–469).

SUMMARY OF THE INVENTION

An object of the present invention is the development of a method and an apparatus by which elongated profile members having an open or closed cross-section and having a relatively thin wall thickness with the accumulation or reduction of material at predetermined points in the cross-section thereof can be manufactured economically.

A further object of the invention is the development of a method and an apparatus by which a wide variety of elongated profile members of different cross-sectional configurations may be manufactured.

A still further object of the invention is the development of a method and an apparatus by which elongated profile members may be manufactured with apparatus which represents a reasonable capital investment.

In accordance with the invention, a band-like initial material of uniform thickness over its cross-section is deformed by cold- and hot-shaping in a continuous work process to produce elongated profile members which have one or more differences in wall thickness at one or more predetermined points in their cross-section.

By utilizing a band-like material of constant wall thickness and employing cold- and hot-shaping operations in a continuous process it is possible to produce economically a wide variety of different profile members in small batches. The ratio of cross-sectional dimension to wall thickness can be varied considerably simply by adjusting the apparatus. Filigree sections with differences in wall thickness at predetermined points in their cross-sections can be manufactured simply and economically.

By appropriate integration of electrical and mechanical means and the observance of the basic principles of metallurgy and of mechanical working of metals it is possible to produce, simply and reliably in a continuous work process, profile members, preferably from hot- or cold-rolled band steel, which have varied cross-sectional configurations and varying wall thicknesses.

In the hot-shaping process, the continuous band-like material is strip heated at one or more areas thereof to an appropriate hot-shaping temperature which in normal structural steels is approximately 900° C. Special guide means are provided which cause the flow of material in the heated area of the band in a direction transverse to the direction of movement of the band-like material. Deformation operations may be carried out in one or more stages. Cooling of the heated band-like material may be controlled as part of the deformation process. Generally the hot-shaping operation is carried out in advance of any cold-shaping operation. However, in special instances the cold-shaping operation may be carried out first in order to assist deformation, especially in the case of certain edge configuration of open profile members and for obtaining stricter tolerance. It may also be desirable in certain instances for the hot-shaping operation to be carried out between separate stages of the cold-shaping operation. Thus, it is possible to adopt different combinations of hot- and cold-shaping operations.

BRIEF DESCRIPTION OF THE DRAWINGS

FIGS. 1 to 17 are cross-sectional views of various forms of metal profile members which may be produced in accordance with the invention;

FIG. 24 illustrates diagrammatically sets of guide rolls for supporting the flow of material in a metal band during hot-shaping;

FIG. 25 is a more complete diagrammatic view of the guide rolls of FIG. 24 with means for adjusting said guide rolls.

DESCRIPTION OF THE PREFERRED EMBODIMENT

Figure 18:
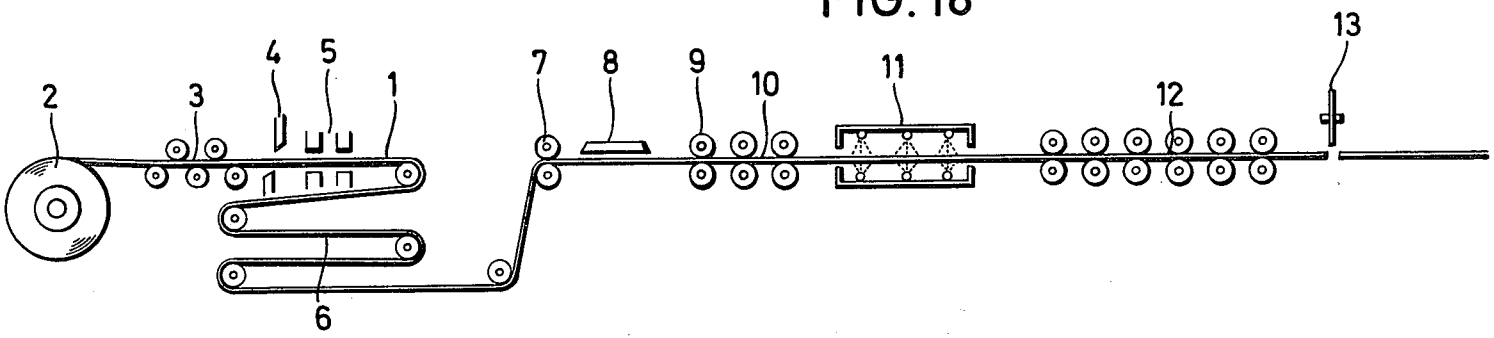
FIG. 18 is a diagrammatic view illustrating an embodiment of the method and apparatus of the invention.

FIG. 18 is a diagrammatic representation of a preferred arrangement of the apparatus for carrying out the method of the invention.

A band-like initial material 1, which may be hot- or cold-rolled band-steel, is drawn from a coil 2, passed through a straightening machine 3, a shearing machine 4 with a welding unit 5 for joining together the band-steel ends of consecutive coils, and then a band-storage device 6 shown symbolically in the form of loops of material. The band-storage device ensures that while the ends of the coils are being joined conveyance of the band beyond the band-storage device is not interrupted.

Figure 23:
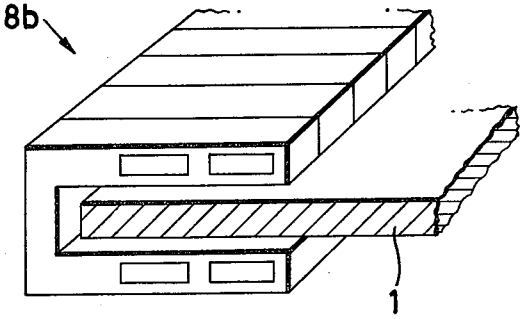
FIG. 23 is a perspective view of a tunnel inductor arranged to heat one edge of a metal band.
Figure 22:
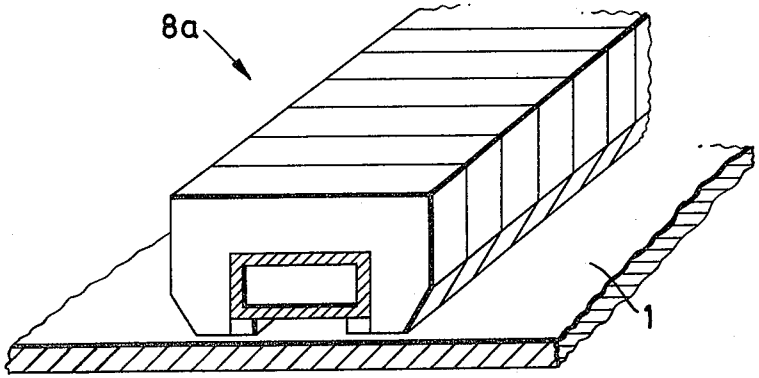
FIG. 22 is a perspective view of a linear inductor arranged to heat the central area of a metal band.

The band 1 is then conveyed without flutter or vibration to a heating zone by way of a pair of drive rolls 7. The heating system 8 preferably is in the form of a medium-frequency induction installation in which, depending upon the position of the zones on the band to be heated, the inductors are linear inductors 8*a*, as shown in FIG. 22, or tunnel inductors 8*b* for band edge heating, as shown in FIG. 23. Although other heat sources such as burner tracks, resistance heating with roll-transformers, conduction heating with high-frequency current sources, etc., may be employed, medium-frequency induction heating is particularly suitable for concentrated high-speed heating. To heat areas remote from the edges of the band the linear inductors are appropriately arranged above and below the moving band if the thickness of the material of the band is substantial. The tunnel inductors are designed to enclose the edges of the band. It is possible to adjust the heating rate such that hot-shaping temperatures can be achieved while the band is moving at a rate normal for profile-rolling and tube-welding operations. Thus, optimum working efficiency is ensured.

By way of a guide system 9, the partially heated band 1 is conveyed to the deformation point 10 which may comprise deforming rollers or possibly matrices which are arranged horizontally, vertically or in any desired angular position. A more detailed description of this follows.

Following the hot-shaping a controlled cooling arrangement is provided to ensure a predetermined residual heat over the entire cross-section of the band. The cooling arrangement is shown as a water spray chamber 11. However, other types of cooling arrangements may be employed, e.g., a water bath or air flue.

The hot-shaped band is then conveyed to a profile-rolling mill 12 or a tube-welding plant which through its drive rollers is basically responsible for the conveyance of the band through the entire installation. The set of drive rolls 7 is intended to tension and guide the band through the hot-shaping zone.

The stages of cold-deformation are carried out in the profile-rolling mill 12 preferably at temperatures which are essentially higher than room temperature and which have a favorable effect on deformation while at the same time reducing redisual deformation tension. A more detailed description of this follows.

Following the cold-shaping operation the finished profile member is then cut to predetermined lengths by a shearing machine 13.

Figure 19:
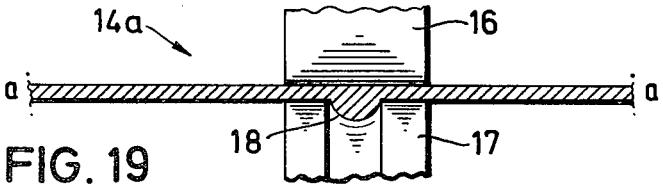
FIGS. 19, 20 and 21 are cross-sectional views showing in sequence hot- and cold-shaping operations.
Figure 20:
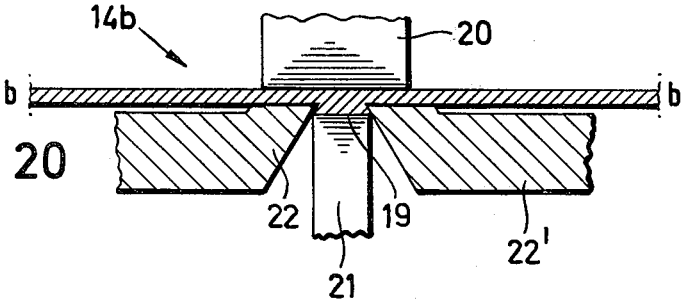
Figure 21:
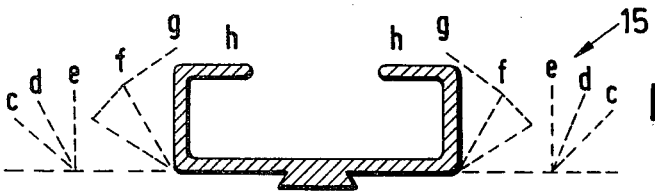

Deformation operations are shown diagrammatically in FIGS. 19 to 21 wherein a C-shaped profile member with a central dove-tail guide is produced. Hot-shaping operations are illustrated at 14*a* and 14*b* followed by a cold-shaping operation at 15. It will be appreciated however that other profile configurations may possibly require a different sequence, i.e. more or less stages in the hot-shaping process and also a different arrangement of the sequence of operations. It will also be appreciated that during the hot-shaping stage and apart from the actual profile-shaping other deformation operations may be carried out, as for example the application of superficial structures, stampings, bosses and the like insofar as these can be performed by rollers or intermittently operated dies.

In process step 14*a*, a bead 18 is first formed by the horizontally mounted rollers 16, 17 supported by the guide system 9. To assist the flow of material transverse to the feed direction of the band and thereby increase the thickness of the band at the bead while the remainder of the band remains unchanged and at its original wall thickness, the rollers 16, 17 may be shaped so as to be slightly spherical. The volume content of the bead 18 should correspond to that of the dove-tail guide 19 which is formed in the second process step **14*b* by the upper roller 20, lower disc 21 and the two vertically mounted discs 22 and 22'. In the profile-rolling mill the hot-shaped band is then formed into a C-shape during the cold-shaping steps c to h which are shown in broken lines in process step 15**. The cold-shaping steps, which serve to end the band at various locations, are carried out on portions of the band other than the portion which was subjected to hot-shaping and do not involve modifications in the thickness of the band as in the hot-shaping procedure.

Of special importance is the guide system 9, one embodiment of which is shown diagrammatically in FIGS. 24 and 25, which is placed downstream of the heating zone. As opposed to hot-rolling, where the flow of material is essentially in the direction of rolling, in the case of the present invention the flow of material is transverse to the feed direction of the band. In upsetting operations within the heated zone of the band the adjacent cold areas of the material are conveyed wedge-like towards each other whereas in stretching operations they are conveyed away from each other. This may be effected by pairs of rollers or discs 23, 23' and 24, 24' which may optionally be provided with drive means. The discs which engage the cold areas of the band 1 are located close to the heated zone 25. By adjusting the angle of the discs relative to the direction of movement of the band 1, the discs cause the material in the heated zone to be upset or stretched, depending upon the angle of the discs, in a direction transverse to the direction of movement of the band. Guide systems of this type which are used when the heated zone lies between the opposite edges of the band cross-section are located immediately upstream of other hot-shaping operations which involve a considerable flow of material in a direction transverse to the movement of the band.

FIG. 25 shows diagrammatically the structural layout of a device for mounting and adjusting the band guide system 9. It comprises two vertical uprights 26, 26' and crosspieces 27, 27' in which adjuster spindles are mounted. By means of the spindles, the guide discs 23, 23' and 24, 24' are adjusted by handwheels 28, either together or separately, such that the discs are moved towards and at right angles to the direction of the movement of band 1 to positions adjacent opposite sides of the heated zone. The guide discs may be mounted in shoes 29. Vertical adjustment and angular adjustment are both controlled by handwheels 30. If there is more than one heated zone in the band it is possible to mount more than two pairs of discs in the crosspieces. Resilient buffers may be utilized in the device to assist in adjusting the pressure applied by the discs to the band.

Other arrangements may be employed for band guidance, e.g. floating discs accommodated in bearing shoes carried in the vertical uprights 26, 26' and which may be adjusted to the predetermined angular position by a common screw device. If the band is relatively thick and has a narrow width, a transverse force for upsetting in the heated zones may also be exerted upon the edges of the band by means of vertically mounted rollers. In the case of very broad bands, the lateral uprights are preferably bridged by transverse yokes on which the adjustable discs or rollers are mounted. There is no risk of sagging and in addition several pairs of discs or rollers may be mounted on the yokes which discs or rollers may be suitably adjusted with respect to the entire width of the band.

In general, the open marginal areas of the band are always urged by the guide means in the appropriate direction for hot-shaping. If, however, more than two hot-shaping areas, apart from the edges, of the band are present, the hot-shaping operation should proceed stagewise, i.e. a central hot-shaping operation should be completed before the adjacent ones are undertaken. In the hot-shaping of the open edges of the band there is generally no necessity for a secondary influence on the direction of flow of the material.

Figure 26:
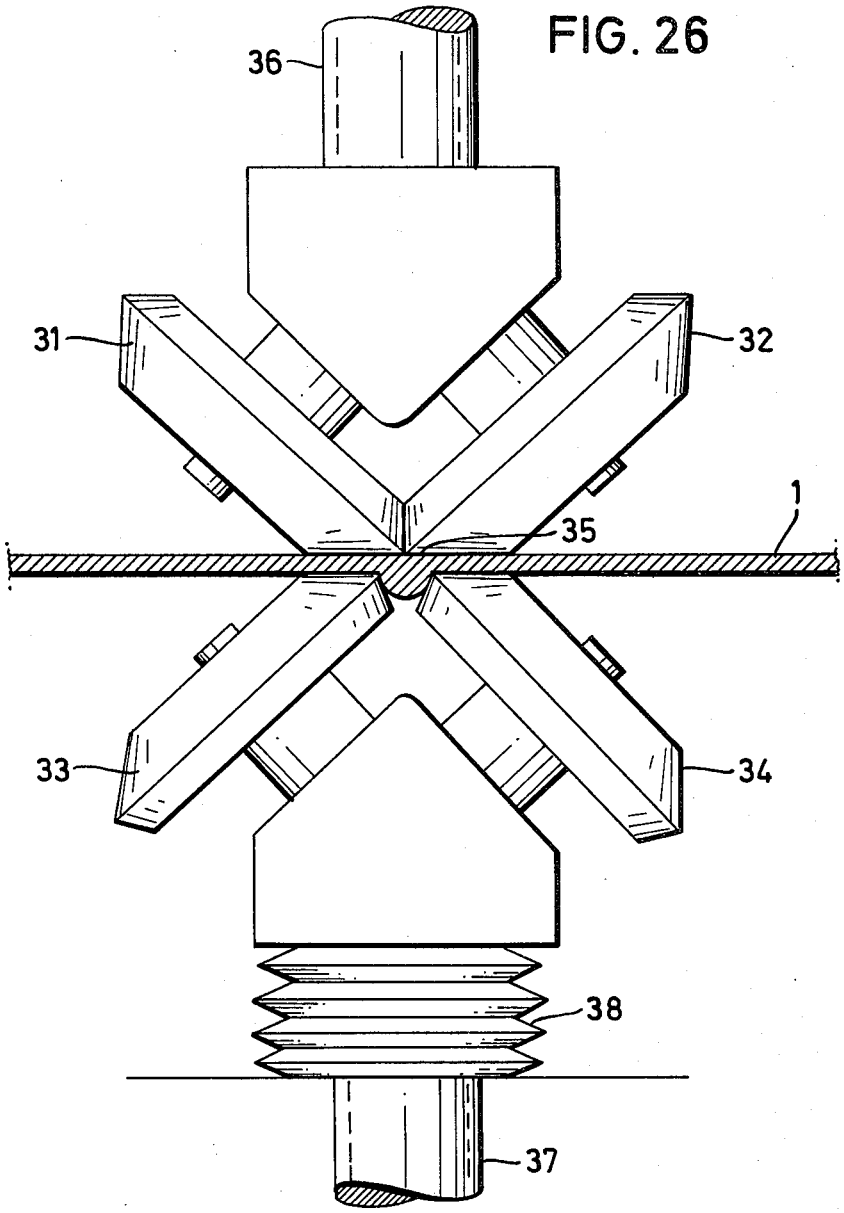
FIG. 26 illustrates an arrangement for urging the flow of material in a metal band in a direction perpendicular to the direction of movement of said metal band.

In the hot-shaping process, in order to urge the flow of material in a direction perpendicular to the rolling direction, it is advantageous to provide a gap in the rollers which gap corresponds to a preliminary or to a final stage of the desired hot-shaping. For this purpose pairs of inclined rolls may be provided as illustrated for example in FIG. 26. This device is somewhat similar to known devices for the continuous welding of sheet or strip metal wherein the edges which have been heated to the welding temperature are pressed together. As illustrated in FIG. 26, the upper inclined rollers 31, 32 are so constructed that they do not form any gap in the plane of contact with the moving band 1. The lower inclined rollers 33, 34 on the other hand have a gap therebetween for shaping a bead 35. The pressure in the horizontal direction at right angles to the direction of movement of the band is exerted upon the heated zone by the adjustor spindles 36, 37 by way of the edges of the inclined rollers in contact with the surface of the band assisted by the resilient cushion in the form of a plate-spring pack 38. This illustrated embodiment may be modified by replacing one pair of inclined rollers by a horizontally rotating shaping roller.

The actual hot-shaping may be carried out in open and/or closed grooves. In view of the slight degree of deformation generally involved, according to a preferred embodiment of the present invention, there is no necessity to provide drive means for the hot-shaping tools since conveyance of the band through the hot-shaping zone is undertaken by the subsequent profile-rolling or tube-welding installations and may be assisted if required by the set of drive rollers located before the hot-shaping zone. The hot-shaping may thus be arranged at any desired angular position on a circular rest providing the most efficienct pressure on the material to be shaped. Thereby, very complicated deformations are often possible in only one single pass or at most in a small number of passes. Apart from the roller-shaping tools which are recommended for better cooling, depending upon conditions, matrices of heat-resistant material may also be employed with internal cooling and possibly with the additional employment of a lubricant.

In the subsequent cooling stage following the hot-shaping the cooling of the entire cross-section by means of water or air should be so controlled that the residual heat will be an aid in the following cold-shaping operation. It is essential, however, that the cold-shaping should take place outside the blue shortness range of the particular material employed. If the mechanical devices which follow can withstand high temperatures, especially with a view to maintaining the bearings lubricated, and if the residual heat is adequate cold-shaping above the blue shortness range should be avoided. The utilization of the residual heat offers many advantages.

In addition to the favorable affect on cold-shaping the employement of cooling media may be reduced and the deformation tensions resulting from cold-shaping, the effects of which are undesirable with respect to cold profiles, may be largely obviated.

In exceptional circumstances, the hot-shaping procedure may follow the cold-shaping. This may be an advantage especially in the case of certain edge configurations of open profile members, since otherwise due to the formation of the edge the actual cold-deformation will become much more difficult and would involve the use of more expensive tools. This is especially true in the case where thickened edges are present. Moreover, with such a modified arrangement, it is also possible to achieve very narrow tolerances in the dimensions of the open limbs.

FIGS. 1 to 17 illustrate examples of various cross-sectional configurations of metal profile members which may be produced in accordance with the invention from a continuous band-like material of uniform thickness. FIG. 1 shows a hot-shaped profile member wherein the opposite edges have been thickened by hot-shaping while the bending has been carried out by cold-shaping. FIG. 2 illustrates a U-shaped profile member wherein the opposite edges have been upset by hot-shaping to form feet which are disposed parallel to the base of the U. The concentration of material in the limbs enables threaded holes, for example, to be made in the limbs. FIGS. 3*a* to 3*f* illustrate other possible edge formations produced by hot-shaping. These edge formations may be formed on either simple or complex cold-shaped profile members.

FIG. 4 illustrates a generally flat profile member having dove-tail shaped edges.

FIG. 5 illustrates a bead-profile member which itself is produced by hot-shaping and is useful during subsequent cold-shaping steps wherein acute-angle outer radii are required. The bead-profile member may be deformed immediately after hot-shaping to any desired cross-sectional shape by cold-shaping. Alternatively, the bead profile member may be coiled for storage after hot-shaping and, after subsequent cold-straightening, used in subsequent processing.

The metal profile member illustrated in FIG. 6 demonstrates that extremely complex deformations of the band-like material, of initially uniform thickness, which may be obtained by hot-shaping without noticeable accumulation of displacement of the material. This has not been possible heretofore with respect to thin-walled and broad profile members. The bending of the edges to an acute angle as illustrated in FIG. 6 is carried out by a subsequent cold profile-rolling operation.

FIG. 7 shows two different profile members which must be accurately formed so that the dove-tail arrangement will fit snuggly together.

FIGS. 8 to 11 are further examples of possible configurations for open rod-shaped profile members.

Figure 12:
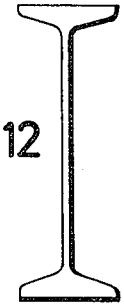
Figure 13:
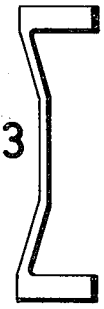
Figure 14:
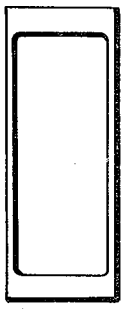

FIGS. 12 to 14 illustrate profile members having very favorable static characteristics. In view of the extremely thin sections the flanges show a distinct accumulation of material. In FIG. 13 it will be seen that the stress point is advantageously placed at the center by cold-shaping of the crosspiece. The hollow profile section of FIG. 14 which is very high relative to its width may be formed into a closed configuration by welding or lock-seaming. The very acute angled outer radii should be noted which improve the efficiency of the connection.

Figure 15:
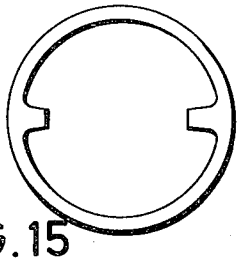
Figure 16:
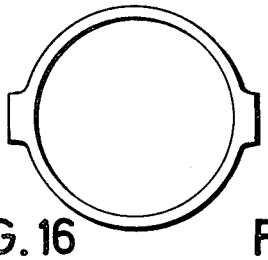
Figure 17:
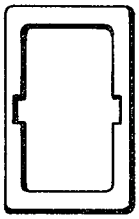

FIGS. 15 to 17 are examples of tube cross-sections as finally completed after hot-shaping in a tube-welding plant.

While the invention has been illustrated in some detail according to the preferred embodiments shown in the accompanying drawings, and while the preferred embodiments have been described in some detail, there is no intention to thus limit the invention to such detail. It is intended to cover all modifications, alterations and equivalents falling within the spirit and scope of the appended claims.

What is claimed is:

1. A method for manufacturing steel profile members of open or closed construction from a continuous steel band of uniform wall thickness, wherein at least one predetermined portion of each of said profile members has a cross-sectional thickness greater than said wall thickness of said band, said method comprising:

(a) providing a source of a continuous steel band of uniform wall thickness over its entire cross-sectional width;

(b) continuously feeding without interruption said steel band along a predetermined path;

(c) continuously heating at least one predetermined portion of the cross-sectional width of said steel band, said at least one heated predetermined portion being intermediate opposite longitudinal edges of said steel band with other portions extending from opposite sides of said heated predetermined portion towards the edges of said steel band;

(d) hot-shaping and deforming at least a cross-sectional part of said heated at least one portion of the cross-sectional width of said steel band at at least one location along said path by engaging only a segment of at least one of said other portions of said band at opposite sides of said heated predetermined portion with a conveying means and conveying said at least one other portion of said band transverse to the feed direction of said band along said path a predetermined distance towards said heated portion to continuously direct flow of steel in said heated portion transverse to the feed direction of said band along said path and increase the volume of steel and reshape and increase the wall thickness of said heated portion while the wall thickness of the remainder of said cross-sectional width of said steel band remains unchanged and at its original wall thickness; and (e) continuously bending by cold-shaping at least one of said other portions of said cross-sectional width of said steel band at at least one other location along said path while the thickness of said at least one other portion remains unchanged and at its original thickness.

2. A method according to claim 1 wherein said hot-shaping procedure is carried out upstream of and before said cold-shaping procedure.

3. A method according to claim 1 wherein said cold-shaping procedure is carried out at least in part upstream of and before said hot-shaping procedure.

4. A method according to claim 1 wherein said cold-shaping procedure is continuously carried out in stages along said path and said hot-shaping procedure carried out between said stages of said cold-shaping procedure.

5. A method according to claim 1 wherein said hot-shaping procedure is carried out on completion of said cold-shaping procedure.

6. A method according to claim 1 wherein said steel band which has been deformed during said hot-shaping procedure is cooled to a temperature essentially above room temperature but outside the blue shortness range relevant to the particular composition of said steel band.

7. A method according to claim 1 wherein said band-like material is heated by medium frequency induction during said hot-shaping procedure.

8. A method according to claim 1 wherein during said hot-shaping procedure superficial structures, stampings, bosses and the like are executed on said band-like material in the deformation area.

9. A method according to claim 1 wherein said other portions of said steel band are conveyed towards each other by at least one pair of rollers engaging the surfaces of said other portions respectively which rollers have rotational planes at an acute angle with respect to the direction of movement of said steel band along said path such that said other portions of said steel band are conveyed wedge-like towards each other as said steel band moves along said path.

10. Apparatus for manufacturing steel profile members of open or closed construction from a continuous steel band of uniform wall thickness, wherein at least one predetermined portion of each of said profile members has a cross-sectional thickness greater than said wall thickness of said band, said apparatus comprising:

(a) means for continuously feeding without interruption a continuous steel band of uniform wall thickness over its entire cross-sectional width along a predetermined path;

(b) means along said path for continuously heating at least one predetermined portion of the cross-sectional width of said steel band, said heated portion being intermediate opposite longitudinal edges of said steel band with other portions extending from opposite sides of said heated predetermined portion towards the edges of said steel band;

(c) means along said path downstream of said heating means for continuously hot-shaping and deforming said at least one heated predetermined portion of the cross-sectional width of said steel band at at least one location along said path and comprising means for conveying at least one of said other portions of said band at opposite sides of said heated predetermined portion transverse to the feed direction of said band along said path a predetermined distance towards said heated portion to continuously direct flow of steel in said heated portion transverse to the feed direction of said band along said path and increase the volume of steel and reshape and increase the wall thickness of said heated portion while the wall thickness of the remainder of said cross-sectional width of said steel band remains unchanged and at its original wall thickness, said conveying means comprising at least one means, spaced along a line extending transverse to said predetermined path, for engaging only a segment of each of said other portions at opposite sides of said heated portion; and (d) means along said path, at at least one other location along said path, for continuously bending by cold-shaping said at least one other portion of said cross-sectional width of said steel band while the thickness of said at least one other portion remains unchanged and at its original wall thickness.

11. Apparatus according to claim 10 further comprising means along said path downstream of said hot-shaping means for cooling said deformed steel band.

12. Apparatus according to claim 10 further comprising the following additional components arranged along said path:

(a) means for straightening said band-like material;

(b) means for shearing and transversely welding said band-like material to join lengths of said band-like material;

(c) means for storing said band-like material;

(d) drive rollers for driving said band-like material along said path;

(e) means for guiding said band-like material along said path;

(f) means for cold-shaping said deformed band-like material downstream from said heating means; and (g) means downstream of said cold-shaping means for shearing said deformed band-like material into predetermined lengths.

13. Apparatus according to claim 10 wherein said feeding means comprises drive rollers positioned along said path for contacting said steel band.

14. Apparatus according to claim 10 wherein said hot-shaping means comprises a plurality of deformation tools and means for adjustably mounting said deformation tools whereby the angle of said deformation tools relative to the direction of movement of said steel band may be adjusted.

15. Apparatus according to claim 10 wherein said heating means comprises at least one linear inductor arranged to heat a predetermined portion of the cross-sectional width of said steel band.

16. Apparatus according to claim 10 wherein said heating means comprises at least one tunnel inductor arranged to surround at least one edge of said steel band for heating a marginal area of said steel band.

17. Apparatus according to claim 10 wherein said means for engaging said other portions comprises at least one pair of rotatably mounted discs spaced from each other downstream of said heating means for engaging the surfaces of said other portions of said steel band at opposite sides respectively of said predetermined heated portion thereof, the rotational plane of at least one of said at least one pair of discs being at an acute angle with respect to the direction of movement of said steel band along said path such that said at least one of said other portions of said steel band is conveyed wedge-like towards said heated portion as said steel band moves along said path.

18. Apparatus according to claim 10 wherein said cold-shaping means comprises profile-rolling means.

19. Apparatus according to claim 10 wherein said cold-shaping means comprises tube-welding means.

20. Apparatus according to claim 10 further comprising means for cooling said deformed steel band downstream of said cold-shaping means.

21. Apparatus according to claim 10 wherein said means for engaging said other portions at opposite sides of said heated portion and conveying said at least one of said other portions towards said heated portion comprises at least one pair of rollers spaced from each other and adapted to engage the surfaces of said other portions of said steel band at opposite sides respectively of said predetermined heated portion thereof, the rotational plane of at least one of said rollers being at an acute angle with respect to the direction of movement of said steel band along said path such that at least one of said other portions of said steel band is conveyed wedge-like towards said heated portion as said steel band moves along said path.

22. Apparatus according to claim 21 further comprising means adjustably mounting said at least one of said rollers for adjusting said acute angle of the rotational plane of said at least one of said rollers to adjust the distance said at least one of said other portions of said steel band is conveyed towards said heated portion.

23. A method for manufacturing steel profile members of open or closed construction from a continuous steel band of uniform wall thickness, wherein at least one predetermined portion of each of said profile members has a cross-sectional thickness different than said wall thickness of said band, said method comprising:

(a) providing a source of a continuous steel band of uniform wall thickness over its entire cross-sectional width;

(b) continuously feeding without interruption said steel band along a predetermined path;

(c) continuously heating at least one predetermined portion of the cross-sectional width of said steel band, said heated portion being intermediate opposite longitudinal edges of said steel band with other portions extending from opposite sides of said heated predetermined portion towards the edges of said steel band;

(d) hot-shaping and deforming the at least one heated predetermined portion of said steel band by engaging only a segment of at least one of the other portions of said band at opposite sides of said heated predetermined portion with a conveying means and conveying said at least one other portion of said band transverse to the feed direction of said band along said path to change the volume of steel and change the wall thickness of said portion while the wall thickness of the remainder of said cross-sectional width of said steel band remains unchanged and at its original wall thickness; and (e) continuously bending by cold-shaping at least one of said other portions of said cross-sectional width of said steel band while the thickness of said at least one other portion remains unchanged and at its original thickness.

24. Apparatus for manufacturing steel profile members of open or closed construction from a continuous steel band of uniform wall thickness, wherein at least one predetermined portion of each of said profile members has a cross-sectional thickness greater than said wall thickness of said band, said apparatus comprising:

(a) means for continuously feeding without interruption a continuous steel band of uniform wall thickness over its entire cross-sectional width along a predetermined path;

(b) means along said path for continuously heating at least one predetermined portion of the cross-sectional width of said steel band, said heated portion being intermediate the opposite longitudinal edges of said steel band with other portions extending from opposite sides of said heated predetermined portion towards the edges of said steel band;

(c) means along said path downstream of said heating means for continuously hot-shaping and deforming the at least one heated predetermined portion of said steel band and comprising means for conveying at least one of the other portions of said band at opposite sides of said heated predetermined portion transverse to the feed direction of said band along said path to change the volume of steel and change the wall thickness of said heated predetermined portion while the wall thickness of the remainder of said cross-sectional width of said steel band remains unchanged and at its original wall thickness, said conveying means comprising at least two means, spaced along a line extending transverse to said predetermined path, for engaging only a segment of each of said other portions at opposite sides of said heated portion; and (d) means along said path, at at least one other location along said path, for continuously bending by cold-shaping at least one of said other portions of said cross-sectional width of said steel band while the thickness of said at least one other portion remains unchanged and at its original wall thickness.

* * * * *